US006488404B2

(12) United States Patent
Zürcher et al.

(10) Patent No.: US 6,488,404 B2
(45) Date of Patent: Dec. 3, 2002

(54) WRISTBAND WITH ARTICULATED LINKS

(75) Inventors: Armin Zürcher, Lengnau (CH); Michael Bach, Biel (CH); Sébastien Bolzt, Moutier (CH); Christophe Guerry, Oberbuchsiten (CH)

(73) Assignee: Montres Rado S.A., Lengnau (CH)

( * ) Notice: Subject to any disclaimer, the term of this patent is extended or adjusted under 35 U.S.C. 154(b) by 12 days.

(21) Appl. No.: 09/893,728

(22) Filed: Jun. 29, 2001

(65) Prior Publication Data

US 2002/0009019 A1 Jan. 24, 2002

(30) Foreign Application Priority Data

Jul. 19, 2000 (CH) ..... 1425/00

(51) Int. Cl.[7] ..... G04B 37/00

(52) U.S. Cl. ..... 368/282; 59/80; 59/82; 63/4

(58) Field of Search ..... 368/281, 282; 59/78, 80, 82, 84–86; 63/3, 4, 9, 10

(56) References Cited

U.S. PATENT DOCUMENTS

| | | | | |
|---|---|---|---|---|
| 4,716,631 A | | 1/1988 | Gay | |
| 5,197,274 A | | 3/1993 | Braun | |
| 6,079,196 A | * | 6/2000 | Linder et al. | 59/80 |
| 6,374,590 B1 | * | 4/2002 | Walch | 59/80 |

FOREIGN PATENT DOCUMENTS

| | | |
|---|---|---|
| CH | 558 639 | 2/1975 |
| CH | 661 416 | 7/1987 |
| EP | 321 036 | 6/1989 |
| EP | 749 709 | 6/1995 |

* cited by examiner

*Primary Examiner*—Vit Miska
(74) *Attorney, Agent, or Firm*—Sughrue Mion, PLLC

(57) ABSTRACT

A wristband (1) with articulated links preferably made of injected ceramics includes per assembly pitch two lateral links (3, 5) each including a threaded hole (11, 12) and a smooth hole (8, 9), a central link (16) pierced with two smooth through holes (13, 27), a bar (15) threaded at least at its ends and a spring bar (14).

8 Claims, 1 Drawing Sheet

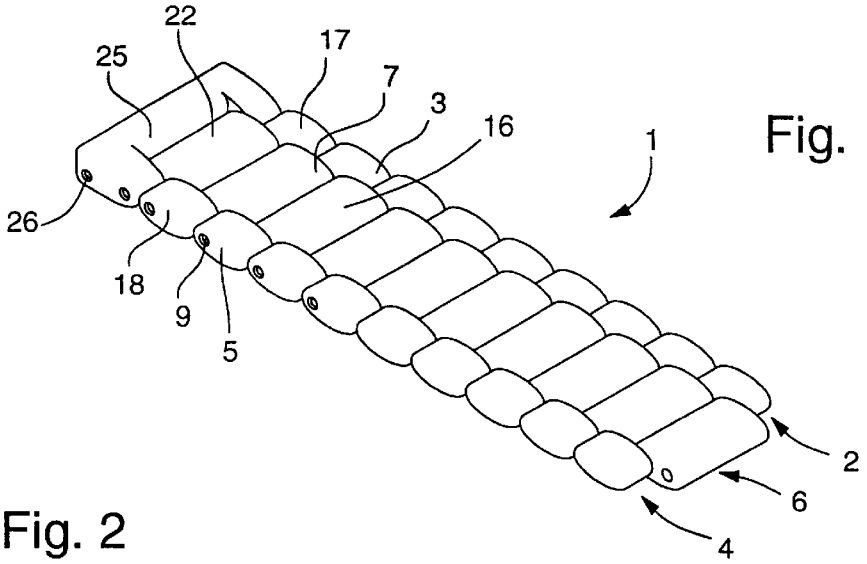
Fig. 1
Fig. 2
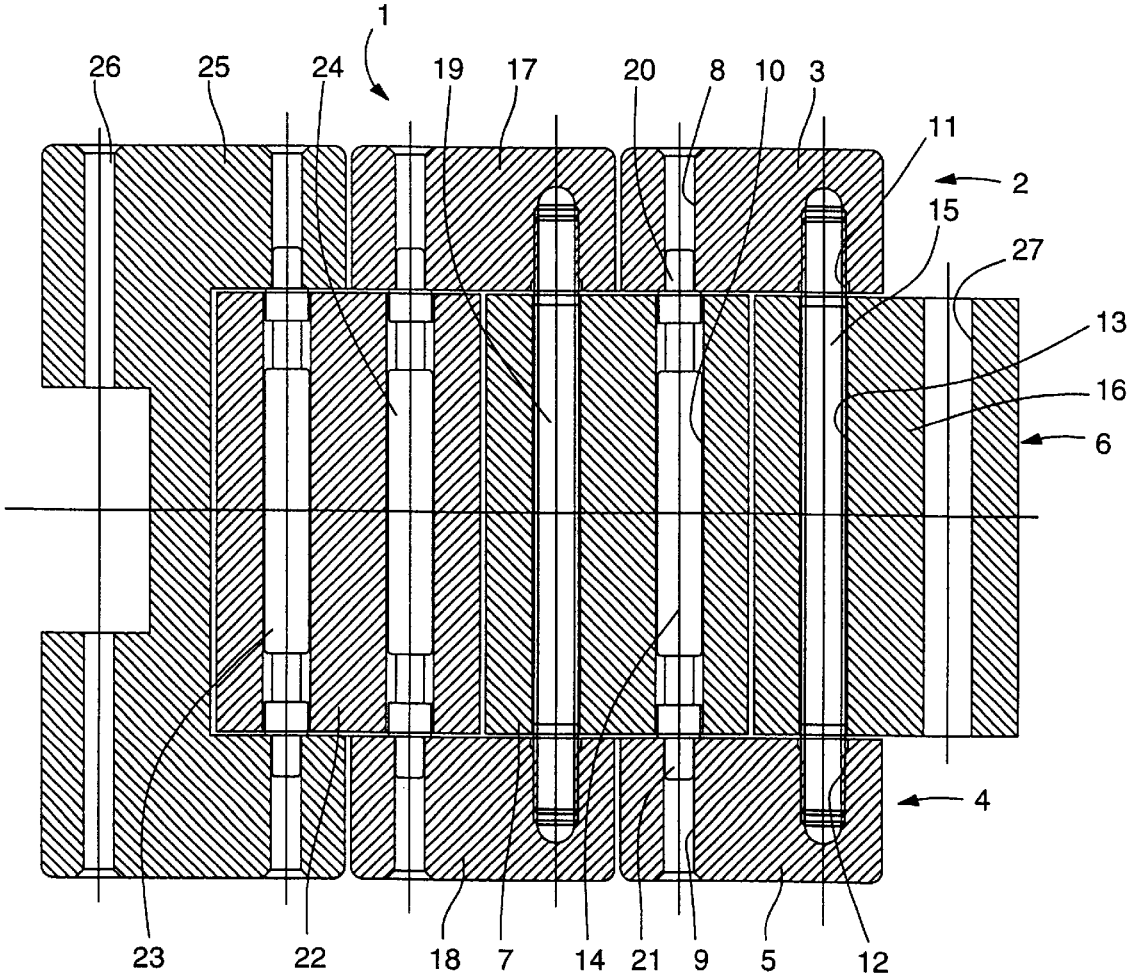

WRISTBAND WITH ARTICULATED LINKS

The present invention relates to a wristband with articulated links including a first row of lateral links marking the first edge of the wristband, a second row of lateral links marking the second edge of the wristband, the links of this second row being aligned on the links of the first, two aligned links defining a pitch of the longitudinal development of the wristband, and at least a third row of central links inserted between the links of the first and second rows and offset by a half-pitch with respect to the links of said first and second rows, each link of the first and second rows including on the one hand respectively first and second holes disposed in alignment with a third through hole made in a first link of the third row and on the other hand, respectively fourth and fifth holes disposed in alignment with a sixth through hole made in a second link of the third row, this second link being contiguous with the first, a first bar being engaged in the first, second and third hole and a second bar being engaged in the fourth, fifth and sixth holes.

A link assembly like that described in the preceding paragraph is given as prior art in U.S. Pat. No. 5,197,274. This assembly includes three rows of links, in particular an upper row, a central row and a lower row. The links of the upper and lower rows are aligned while the links of the central row are offset with respect to the links of the other rows. Each link of the central row is pierced with two through holes and each link of the upper and lower rows is pierced with two holes, one through hole and the other blind. On the one hand, a through hole of a first link of the central row is aligned with two through holes made respectively in a link of the upper row and in a link of the lower row, which results in three aligned holes in which a first bar is engaged held in the link of the central row by a necked sleeve. On the other hand, a through hole of a second link of the central row is aligned with two blind holes respectively made in the link of the upper row and the link of the lower row, resulting in three aligned holes in which a second bar is engaged, held by being driven into each of the links of the upper and lower rows.

The assembly described above has, however, several drawbacks. It will be noted first of all that the fact that the first bar is held in the first link of the central row by a neck arranged thereon exerts non negligible mechanical stress on the link, which may cause it to shatter, if it is made of a friable and brittle material, for example ceramics. It will also be noted that driving the second bar into each of the second links of the upper and lower rows exerts even further stress thereon such that they may also shatter during this operation if, as already stated, these links are made of a friable and brittle material. It will be noted finally that driving in the bar is not considered a sufficiently reliable holding means since following movements at on the wristband, the bar may work free of its seat.

In order to overcome the drawbacks cited in the preceding paragraph, aforecited U.S. Pat. No. 5,197,274 proposes screwing the bars into the links of an lateral row and keeping them blocked in by means of studs screwed into the other lateral row. This construction is complicated both because of the number of parts which it requires and because of the time which has to be dedicated to assembling the wristband, without taking account of the ever present risk of a stud becoming unscrewed which would then require it to be blocked by adhesive. In fact, the Applicant of the present invention has observed that one of the bars in question could very well be directly screwed into the aligned rows of the two lateral rows.

In conclusion to the foregoing, and with regard to the first paragraph of this description, the present invention is characterised in that the second bar is threaded at least at its ends to be screwed into internal screw threads made in the fourth and fifth holes made respectively in the links of the first and second rows.

The present invention is also characterised by the method for assembling the different elements forming the wristband, such method being described in detail in the following description.

The features and advantages of the invention will appear now in the following description, made with reference to the annexed drawings and providing, by way of non limiting explanation, an advantageous embodiment of the invention, in such drawings:

FIG. 1 is a perspective view of the wristband of the invention; and

FIG. 2 is a plan cross-section of a part of the wristband shown in FIG. 1.

As is seen in FIGS. 1 and 2, wristband 1 with articulated links 3, 5, 17, 18, 7, 16 includes a first row 2 of lateral links 3, 17 which mark the first edge of wristband 1. Wristband 1 further includes a second row 4 of lateral links 5, 18 which mark the second edge of wristband 1. FIGS. 1 and 2 show that the links of the first and second rows are aligned with respect to each other, two aligned links, for example links 3 and 5, defining a pitch in the longitudinal development of the wristband. Finally, wristband 1 includes at least a third row 6 of central links 7, 16 which are inserted between the links of the first and second rows and which are offset by a half-pitch with respect to the links of said first and second rows.

It will be noted here that a single row of central links is shown. Without it being necessary to show this, it is clear that there could be other rows of central links, for example three rows instead of a single row or even five rows instead of a single one. In the case of three rows of central links, there would be, in this order, a first lateral link, a second central link offset with respect to the first, a third central link in phase with the first, a fourth central link offset with respect to the first and a fifth lateral link in phase with the first, the essential point being an uneven number of rows of central links offset with respect to each other.

As is shown in FIG. 2, each aligned link of the first and second rows, for example links 3 and 5, includes on the one hand and respectively first and second holes 8 and 9 disposed in alignment with a third through hole 10 made in a first link 7 of third row 6. Each aligned link of the first and second rows, for example links 3 and 5, includes on the other hand and respectively, fourth and fifth holes 11 and 12 disposed in alignment with a sixth through hole 13 made in a second link 16 of third row 6, this second link 16 being contiguous with first row 7.

Finally, a first bar 14 is engaged in first, second and third holes 8, 9 and 10 and a second bar 15 is engaged in the fourth, fifth and sixth holes 11, 12 and 13.

As is also shown in FIG. 2, the invention is characterised and original in that the second bar 15 is threaded at least at its ends to be screwed into internal screw threads made in fourth and fifth holes 11 and 12 which are made respectively in links 3 and 5 of the first and second rows 2 and 4. The connection between two lateral links 3 and 5, between which is inserted a central link 16, is thus achieved by means of a simple bar 15 threaded at least at its ends and screwed into internal screw threads made in holes 11 and 12 made in lateral links 3 and 5. A first section or pitch of the wristband has thus been obtained.

FIG. 2 shows a second section of the wristband, of identical manufacture, and which includes the assembly of two lateral links 17 and 18 between which is placed central link 7. The assembly means include here screwed bar 19.

The two sections of the wristband which have just been described are assembled by means of a bar 14 as shown in FIG. 2. A spring bar may be used as shown in the Figure. This bar includes a spring (not shown) in its central portion which acts on two moving heads 20, 21. When bar 14 is in place, heads 20 and 21 are projected into holes 8 and 9 of links 3 and 5. The two sections are thus secured to each other while allowing one to be articulated on the other.

FIG. 2 shows that the first and second holes 8 and 9 are through holes which allows the first and second sections to be dismantled to lengthen or shorten the length of the wristband as required, by pushing heads 20 and 21 back of bar 14 using a small tool. On a conventional wristband (see FIG. 1), one will ensure that at least certain links (for example three or four links located on the side of the wristband clasp) forming the first and second rows include through holes 8 and 9, while the next links will be provided with blind holes, this being for the aesthetic purpose of concealing these next links from view. Of course, once mounted, the sections provided with links with blind holes can no longer be dismantled.

Returning now to fifth and sixth threaded holes 11 and 12 in links 3 and 5 of first and second rows 2 and 4, it will be observed that these holes may be blind or through holes. For aesthetic reasons and as is shown in FIG. 2, blind holes will be preferred, in which case bar 15 may be threaded either over its entire length, or only at its ends. In the case however in which one opts for through threaded holes 11 and 12, only bars 15 threaded just at their ends will be used to avoid any inadvertent unscrewing of said bars 15.

In order to make the links forming the wristband of the invention, a vast range of materials may be envisaged, for example steel. This structure is however particularly well suited if the links which form first, second and third rows 2, 4 and 6 are made of injected ceramics.

Without entering into details, it will be mentioned here that in order to made an injected ceramic link, a ceramic powder is used, mixed with a plastic binding agent. This composite material is then injected into a mould which is heated for the purpose of eliminating the plastic binding agent. The part obtained is then sintered at a high temperature to obtain cohesion of the ceramic powder, then the desired link. This thus not only allows the desired contours or shapes to be obtained for the link, but also the holes to be made in the link whether they are through or blind holes, threaded or smooth.

Screwing a threaded bar 15 into threaded holes 11 and 12 of lateral links 3 and 5 does not exert any mechanical stress on the latter which could cause them to shatter if they are made of ceramic material. The same is true of spring bar 14 which, once in place, does not exert any stress on the links. The use of injected ceramics also allows links to be manufactured according to the invention without using any kind of mechanical machining which is expensive when such material is used.

It will also be mentioned that the proposed construction is very economical because of its simplicity and the small number of parts implemented namely lateral links which are all manufactured in the same way, central links, spring bars and threaded bars.

This description will end by explaining the method for assembling the wristband of the invention. Reference will be made to FIG. 2 for this purpose.

One starts by providing a lateral link 3 to begin first row 2, then second bar 15 which is threaded at least at its ends, is screwed into threaded hole 11. A first central link 16 is then provided to begin first row 6, then second bar 15 is placed, via its free end, into one of the two holes 13 of the central link. Finally, a lateral link 5 is provided to begin second row 4, then this lateral link is screwed, by being pivoted, onto second bar 15, the threaded part of the latter being inserted into threaded hole 12 of the same lateral link. A first section of the wristband has thus been made.

A second section is assembled in the same way as just described, this second section also being formed of two lateral links 17 and 18, a second central link 7, these three links being connected to each other by a screwed bar 19. A spring bar 14 is then introduced into a through hole 10 of second central link 7.

Finally the first and second sections are assembled by causing second central link 7 of the second section to penetrate the space defined by the two lateral links 3 and 5 and central link 16 of the first section. Heads 20 and 21 of spring bar 14 then penetrate the first and second holes 8 and 9 respectively of lateral links 3 an 5 of the first section.

Finally, other sections are assembled in the same way until the desired wristband length is obtained.

FIGS. 1 and 2 further show how the wristband thus assembled can be connected to a clasp for example. Thus, FIG. 2 shows a link 25 spread out over the entire length of the wristband and pierced with a hole 26 intended to receive a last bar (not shown) which also passes through a portion of the clasp (not shown). This link 25 is articulated on a central link 22 by means of a spring bar 23. Central link 22 is in turn articulated on lateral links 17 and 18 by means of a spring bar 24.

What is claimed is:

1. A wristband with articulated links including a first row of lateral links marking the first edge of the wristband, a second row of lateral links marking the second edge of the wristband, the links of this second row being aligned on the links of the first, two aligned links defining a pitch of the longitudinal development of the wristband, and at least a third row of central links inserted between the links of the first and second rows and offset by a half-pitch with respect to the links of said first and second rows, each link of the first and second rows including on the one hand respectively first and second holes disposed in alignment with a third through hole made in a first link of the third row and on the other hand, respectively fourth and fifth holes disposed in alignment with a sixth through hole made in a second link of the third row, this second link being contiguous with the first, a first bar being engaged in the first, second and third holes and a second bar being engaged in the fourth, fifth and sixth holes, wherein the second bar is threaded at least at its ends to be screwed into internal screw threads made in the fourth and fifth holes made respectively in the links of the first and second rows.

2. A wristband according to claim 1, wherein the first bar is a spring bar.

3. A wristband according to claim 1, wherein the first and second holes are through holes at least on certain links forming the first and second rows.

4. A wristband according to claim 1, wherein the fourth and fifth holes are through holes.

5. A wristband according to claim 1, wherein the fourth and fifth holes are blind holes.

6. A wristband according to claim 1, wherein the second bar is threaded over its entire length.

7. A wristband according to claim 1, wherein the links of the first, second and third rows are made of injected ceramics.

8. A Method for assembling the wristband defined in claim 1, wherein it includes the following succession of steps:

a lateral link is provided to begin the first row, then the second bar which is threaded at least at its ends, is screwed into the threaded hole of said link, a first central link is provided to begin the third row, and the second bar is placed, via its free end, into one of the two holes of the central link, a lateral link is provided to begin the second row, and said lateral link is screwed, by being pivoted, onto the second bar, by inserting the threaded part of the latter into the threaded hole of the same lateral link, a first section of the wristband thus being made, a second section is assembled in the same way as just described, this second section also being formed of two lateral links a second central link, these three links being connected to each other by a screwed bar, and a spring bar is introduced into a through hole of the second central link, the first and second sections are assembled by causing the second central link of the second section to penetrate the space defined by the two lateral links and central link of the first section, the heads of the spring bar then penetrating the first and second holes respectively of the lateral links of the first section, and other sections are assembled in the same way until the desired wristband length is obtained.

* * * * *